US006976746B2

(12) United States Patent
Shimamura

(10) Patent No.: US 6,976,746 B2
(45) Date of Patent: Dec. 20, 2005

(54) INK JET RECORDING APPARATUS ADAPTED TO DISPLAY STATE OF USE OR TIME FOR REPLACEMENT OF CARTRIDGE AND CONTROL METHOD FOR SAME

(75) Inventor: Yoshiyuki Shimamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 10/730,812

(22) Filed: Dec. 8, 2003

(65) Prior Publication Data

US 2004/0113974 A1 Jun. 17, 2004

(30) Foreign Application Priority Data

Dec. 11, 2002 (JP) ..... 2002-359095

(51) Int. Cl.[7] ..... B41J 2/195

(52) U.S. Cl. ..... 347/7

(58) Field of Search ..... 347/7, 23, 30, 347/31, 36, 85, 86

(56) References Cited

U.S. PATENT DOCUMENTS

| | | | | |
|---|---|---|---|---|
| 4,965,596 | A * | 10/1990 | Nagoshi et al. | 347/36 |
| 5,113,206 | A * | 5/1992 | Fukazawa | 347/86 |
| 5,172,140 | A * | 12/1992 | Hirabayashi et al. | 347/36 |
| 5,221,935 | A * | 6/1993 | Uzita | 347/36 |
| 6,227,661 | B1 * | 5/2001 | Hayakawa | 347/86 |
| 6,476,926 | B1 * | 11/2002 | Yano et al. | 358/1.14 |
| 6,547,363 | B1 * | 4/2003 | Shinada et al. | 347/19 |
| 6,595,616 | B2 * | 7/2003 | Takahashi et al. | 347/23 |
| 6,612,683 | B2 * | 9/2003 | Takahashi et al. | 347/30 |
| 6,742,887 | B2 * | 6/2004 | Ando | 347/109 |
| 6,908,182 | B2 * | 6/2005 | Nakazawa et al. | 347/86 |

* cited by examiner

*Primary Examiner*—Anh T.N. Vo
(74) *Attorney, Agent, or Firm*—Morgan & Finnegan, LLP

(57) ABSTRACT

An object of the present invention is to make it possible in an ink jet recording apparatus to appropriately display the state of use or the time for replacement of an ink cartridge in which a waste ink storing member for storing waste ink and an ink storing member for storing ink to be supplied to a recording head are combined. In the present invention, based on the percentage of the ink remaining in the ink storing member for storing ink and the percentage of the amount of waste ink that can be received in the waste ink storing member, the smaller one of them is displayed.

4 Claims, 4 Drawing Sheets

INK JET RECORDING APPARATUS ADAPTED TO DISPLAY STATE OF USE OR TIME FOR REPLACEMENT OF CARTRIDGE AND CONTROL METHOD FOR SAME

BACKGROUND OF THE INVENTION

1. Field of the Invention

The present invention relates to an ink jet recording apparatus for performing recording by ejecting ink and to the way of display of the state of use of an ink cartridge in an ink jet recording apparatus. Particularly, the present invention relates to display or indication of the state of use or the time for replacement of a replaceable cartridge in connection with a replaceable ink cartridge having a structure in which ink to be used for recording and waste ink discharged while the cartridge is used in an ink jet recording apparatus can be accommodated.

2. Related Background Art

In the field of ink jet recording in which recording is performed by ink ejected from ink ejection ports provided on a recording head, a serial type ink jet recording apparatus that performs recording while moving the recording head relative to a recording medium in a scanning manner has been conventionally known. In connection with this serial type ink jet apparatus, an arrangement in which ink is supplied to the recording head from an ink tank disposed on the apparatus has been known as a method of supplying ink to the recording head. Furthermore, in order to avoid ink ejection errors in the recording head, it has been known to provide recovery means so as to cause ink to be ejected or sucked from ejection ports of an ink ejection part so that the ejected or sucked ink is stored as waste ink in a waste ink tank. That recovery means is means adapted to cause the ink to be ejected for the purpose other than recording, and it includes not only ejecting operation by suction but also a preliminary ejection process for causing ink to be ejected during a period other than recording. Still further, an ink cartridge in which the aforementioned ink tank for supplying ink and waste ink tank are combined has also been known. Especially, an ink cartridge in which the aforementioned ink tank for supplying ink and waste ink tank are combined is disclosed in U.S. Pat. No. 6,281,911. The ink cartridge disclosed in this document is provided with a member for storing ink and a member for storing waste ink and adapted in such a way that waste ink discharged by a recovery operation of a printer is returned to the ink cartridge so as to be stored in the member for storing waste ink.

In the structure in which the ink discharged by a recovery process is returned to an ink cartridge so that the ink is stored in a dedicated storing member as described above, waste ink discharged at the time of starting of the recording operation or during the recording operation is accumulatively stored in the storing member as ink is consumed by the recording operation. Generally, the storing member for storing waste ink has a certain capacity for storing waste ink. If the storing member is caused to store waste ink beyond its capacity, the waste ink will overflow, and eventually the interior of the apparatus or the circumference of the ink cartridge will be contaminated. In connection with this, arrangements adapted to regulate discharged waste ink amount and when the waste ink amount exceeds a predetermined amount or when the remaining capacity for waste ink becomes smaller than a predetermined amount, to inhibit recording after that or give warning concerning waste ink, has been conventionally known.

From the viewpoint of ink cartridge design, it is preferable that the capacity of the member for storing waste ink be made so large that the waste ink mount does not exceed its full capacity before the ink in the ink cartridge is fully consumed. For that purpose, it is necessary to determine the capacity of the storing member taking into consideration the maximum amount of waste ink discharged by suction discharge and preliminary ejection, etc. However, it is important for the ink cartridge to be kept compact in order to attain downsizing of the apparatus. Therefore, a design intended to provide a waste ink storing member having a sufficient capacity in an ink cartridge can be a limiting factor for downsizing of the apparatus.

Both of the member for storing ink and the member for storing waste ink can be made as storing members in the form of bags. In that case, since the volume of those members varies, even when the volume of the member for storing waste ink increases with recovery operations, the volume of the member for storing ink decreases with ink consumption by. recording operations or recovery operations. Therefore, in the arrangement in which ink and waste ink are stored in respective storing members in the form of bags provided in one cartridge, the member for storing waste ink will not become a fully filled state before ink is consumed even if recovery operations are frequently performed. In other words, in the case that an ink supplying bag that stores ink to be used for recording and a waste ink storing bag are accommodated in one ink cartridge, even if ink to be supplied is fully discharged by recovery operations and stored as waste ink, the volume of the waste ink combined ink cartridge may be made as small as the volume in which an ink supplying bag filled with ink and an empty waste ink storing bag can be accommodated, since the ink supplying bag is evacuated by the same volume as the waste ink storing bag is filled.

However, in the case of a color ink jet recording apparatus in which multiple inks of different colors are used, multiple types of inks are discharged by the recovery process. Therefore, a problem can arise even when an ink cartridge having the above-described structure is used.

In the color ink jet recording apparatus capable of recording color images by ejecting multiple inks of different colors, there is adopted a structure in which multiple ink cartridges corresponding to different colors are attachable or a structure in which an ink cartridge that can integrally accommodate multiple inks of different colors is used. In the former structure, it is not necessary to provide a member for storing waste ink in each of the ink cartridges for different colors. That is because waste ink generated by the recovery means is discharge from ejection ports of the recording head, and therefore the flow path of the waste ink is only one. For that reason, it is sufficient to provide at least one cartridge for storing waste ink. In the latter structure in which inks of multiple colors are integrally accommodated, it is general practice that one waste ink storing member is provided in the ink cartridge.

FIG. 4 shows a structure in which multiple ink cartridges for different colors can be attached. In this structure, each of the color inks are stored in individual ink cartridges 2, 3, 4 and 5 and waste ink is to be stored in the cartridge 2 for black ink. In this case, since not only waste ink of black but also waste inks of the other colors such as Y, M or C are stored in the waste ink storing member 6, the volume of the waste ink storing member 6 is required to be made large. In the structure shown in FIG. 4, even in the case that the waste ink storing member 6 in the form of a bag is used, it is necessary to make the capacity thereof large, since waste inks of the other colors are also to be stored.

Similarly, in the structure that uses an ink cartridge in which multiple inks of different colors are integrally accommodated, it is necessary to make the volume of a waste ink storing member large, since waste inks of all of the colors are stored in the waste ink storing member.

As per the above, in the ink cartridge system like the structure shown in FIG. 4 in which only one ink cartridge among a plurality of ink cartridges is provided with a waste ink storing member, it is not necessary to combine waste ink storing members to all of the ink cartridges. On the other hand, in the structure in which inks of all of the colors are integrally accommodated, it is sufficient to provide only one waste ink storing member in the ink cartridge. However, since waste inks discharged from all of the ink cartridges flow into the waste ink storing member in a mixed manner, it is necessary upon designing the volume of the waste ink storing member to consider the overall balance. If a waste ink storing bag is designed to have a volume that can store the volume of the inks to be supplied in all of the ink cartridges, overflow of the waste ink storing bag will not occur. In that case, however, the size of the ink cartridge is increased, so that there arise problems of size and cost of the apparatus.

In practice, inks to be supplied are ejected onto recording sheets for the most part, and therefore the waste ink storing bag need not store the volume of the inks to be supplied in all of the ink cartridges. However, depending on the state of use by users, recovery operations can be frequently performed. Therefore, there still remains the problem that waste ink overflows from a waste ink storing member or the problem that the operation of an apparatus is compelled to be stopped due to incapability of storing waste ink.

SUMMARY OF THE INVENTION

The present invention has been made in order to solve the above-described problems. An object of the present invention is to realize appropriate display of the state of use or the time for replacement of an ink cartridge in which a waste ink storing member for storing waste ink and an ink storing member for storing ink to be supplied to a recording head are combined.

A characterizing feature of the present invention resides in that based on the percentage of the ink remaining in an ink storing member for storing ink and the percentage of the amount of waste ink that can be received in a waste ink storing member, the smaller one of them is displayed. In addition, as to the time for replacement of an ink cartridge, based on the remaining amount of ink and the amount of waste ink that can be received, such one of them as come to the time for replacement earlier is used for display of the time for replacement.

According to the present invention for attaining the above-described object, there is provided an ink jet recording apparatus to which an ink cartridge provided with an ink storing member for storing ink to be used for recording and a waste ink storing member for storing waste ink discharged from a recording head is detachably attached to perform recording by ejecting ink supplied from the ink storing member of the attached ink cartridge out of the recording head, comprising, recovery means for causing ink to be discharged from the recording head for a purpose other than recording, a waste ink path that allows the waste ink discharged from the recording head by the recovery means to be stored in the waste ink storing member of the attached ink cartridge, determination (or acquisition) means for determining (or acquiring) a remaining amount of ink in the ink storing member and a remaining storable amount of waste ink that can be stored in the waste ink storing member, and changing means for changing display on state of use of the ink cartridge based on the determined (or acquired) remaining amount of ink and remaining storable amount of waste ink.

Furthermore, according to the present invention, there is provided a control method for an ink jet apparatus for performing recording by ejecting ink from a recording head, provided with recovery means for causing ink to be discharged from the recording head for a purpose other than recording and to which an ink cartridge provided with an ink storing member for storing ink to be used for recording and a waste ink storing member for storing waste ink discharged from the recording head is detachably attached, comprising a determination step of determining a remaining amount of ink in the ink storing member and a remaining storable amount of waste ink that can be stored in the waste ink storing member, and a changing step of changing display on state of use of the ink cartridge based on the determined remaining amount of ink and remaining storable amount of waste ink.

Figure 1:
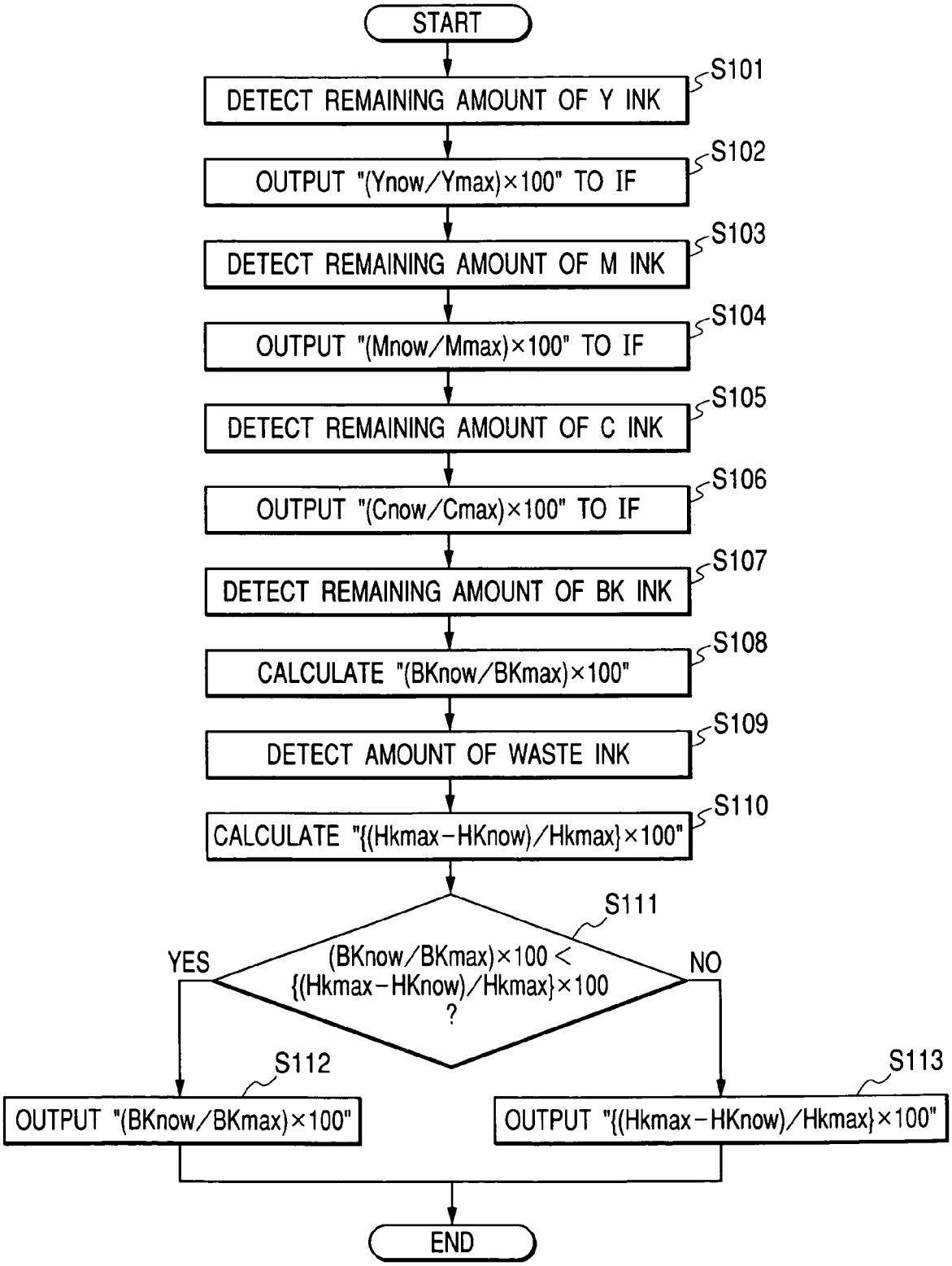
FIG. 1 is a flow chart illustrating a process for detecting the state of use of an ink cartridge as an embodiment of the present invention.

DESCRIPTION OF THE PREFERRED EMBODIMENTS (First Embodiment)

In the following, a color ink jet recording apparatus to which the present invention is applied will be described with reference to the accompanying drawings. First, an overall ink supply and discharge systems of the color ink jet recording apparatus will be described with reference to FIG. 4. Since the basic structure of the ink jet recording apparatus 1 is the same as that of generally used ink jet apparatuses, the description thereof will be omitted.

Reference numeral 2 designates a combined ink cartridge in which a member for storing waste ink (i.e., a waste ink tank) 6 and a member for storing ink to be used for recording (i.e., an ink tank) 7 are accommodated, and reference numerals 3, 4 and 5 designate ink cartridges. Each of these cartridges is adapted to be detachably attached to the ink jet recording apparatus 1.

In this embodiment, in the interior of the waste ink combined ink cartridge 2, there is provided a waste ink storing bag 6 and a ink supplying bag 7 for black (which will be abbreviated as BK hereinafter). In the interior of the ink cartridge 3, there is provided an ink supplying bag 8 for yellow (which will be abbreviated as Y hereinafter). Similarly, in the interior of the ink cartridges 4 and 5 there is provided ink supplying bags for cyan (which will be abbreviated as C hereinafter) and magenta (which will be abbreviated as M hereinafter).

Ink tubes 10, 11, 12 and 13 are connected to the ink bags of the ink cartridges 2, 3, 4 and 5 respectively via supply needles (not shown) so that inks are supplied to a recording head 14. The recording head is held by a carriage (not shown) so as to be reciprocated in the longitudinal direction along the surface of a platen 18.

A recording sheet is conveyed along the surface of the platen 18 in the direction perpendicular to the moving direction of the recording head 14 so that printing is performed on the recording sheet by the recording head 14.

Cleaning of ink nozzles of the recording head 14 or suction of ink is performed in order to maintain the printing quality of the recording head. For that purpose, a head cap 15 is disposed at a position outside the moving range of the recording head 14 under printing. The recording head 14 is periodically moved to the position of the head cap 15. The head cap 15 is connected with a waste liquid tube 16 for recovering waste ink having been recovered or sucked from the recording head 14 from the head cap 15. A waste liquid pump 17 is inserted in the waste liquid tube as a drive source used for the recovery of waste ink. The waste ink recovered by the waste liquid pump 17 via the waste liquid tube 16 flows through a waste liquid tube 9, and the waste ink is joined to the waste ink storing bag 4 via a waste liquid needle (not shown). The waste ink is absorbed by a waste ink absorbing material (not shown) accommodated in the interior of the waste ink storing bag 6 so as to be recovered therein.

Figure 2:
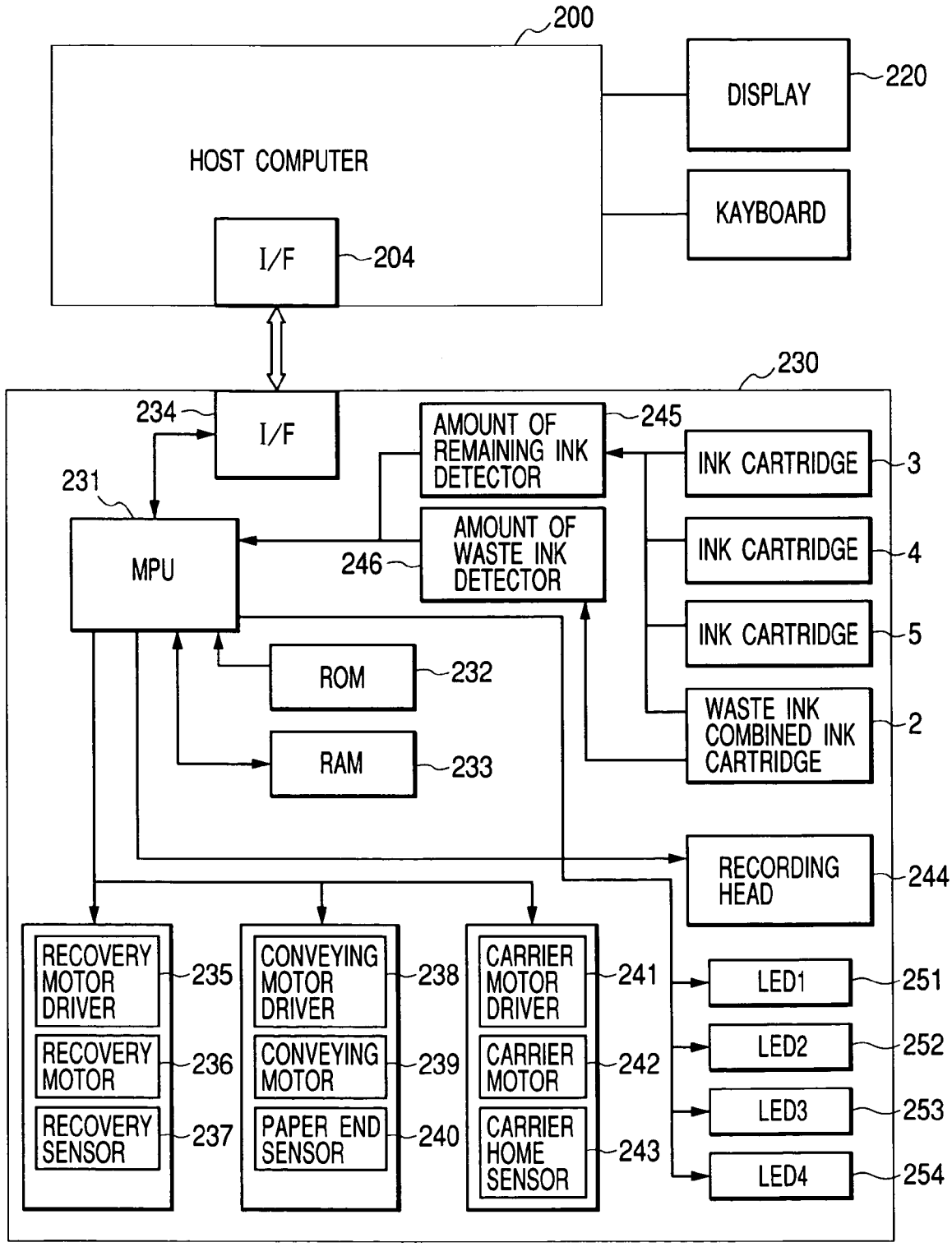
FIG. 2 is a block diagram showing an example of a host computer and an ink jet recording apparatus to which the present invention can be applied.

FIG. 2 is a block diagram showing an example of the arrangement of a host computer 200 and the ink jet recording apparatus, where the area designated by numeral 230 corresponds to the ink jet recording apparatus 1.

Reference numeral 231 designates a micro processor unit (which will be referred to as a "printer micro computer" or MPU hereinafter), reference numeral 232 designates a ROM in which programs for controlling the recording apparatus and a program for detecting the amount of remaining ink are stored, and reference numeral 233 designates a RAM to be used as a working area upon recording or other operations. The MPU 231 supplies driving pulses to a conveying motor driver 238, a carrier (or carriage) motor driver 241 and a recovery motor driver 237, while checking the presence/absence of a recording sheet, the position of a carrier (or carriage) and the state of a recovery unit by means of sensors such as a paper end sensor 240, a carrier (or carriage) home sensor 243 and a recovery sensor 237, so as to control a conveying motor 239, a carrier (or carriage) motor 242 and a recovery motor 237. Recording data and commands for printing are sent from the host computer 200 to the MPU 231 via an interface 204. Internal information of the printer such as information on the amount of remaining ink is sent from the microprocessor 231 to the host computer via an interface 234. A recording head 244 records the printing data sent from the host computer 200 via the interface 204 under a control of the MPU 231.

On the ink jet recording apparatus 1, there are mounted four detachable ink cartridges including a waste ink combined cartridge 2 and ink cartridges 3, 4 and 5. The amount of remaining ink can be detected by an amount of remaining ink detector 245 for each of the ink cartridges. The detection result is transmitted to the MPU 231. On the other hand, the amount of waste ink is detected by an amount of waste ink detector 246 and the detection result is transmitted to the MPU.

The host computer 200 is informed of the state of use of the ink cartridges, which is calculated by a process that will be described later in the MPU 231, by the MPU via the interface 204. The host computer is adapted to display the state of use of the ink cartridges on a display 220. In a typical case, the state of use of each cartridge is displayed in terms of percentage in the form shown in FIG. 3 to allow a user to know the state.

Reference numerals 251, 252, 253 and 254 are LEDs, which are controlled to be turned on/off by the MPU 231.

According to the present invention, upon displaying the state of use of an ink cartridge in which ink to be supplied and waste ink discharged by a recovery process can be stored, it is possible to selectively display the amount of remaining ink to be supplied and the amount of waste ink that can be stored. In a specific form of the invention, either one of the remaining amount of ink to be supplied or the storable amount for waste ink that is closer to the state requiring replacement of the ink cartridge is displayed as the state of use of an ink cartridge. In other words, the remaining amount of ink to be supplied and the storable amount for waste ink are monitored separately as the state of use of the ink cartridge, so that either one of the remaining amount of ink to be supplied or the storable amount for waste ink that is closer to the time for replacement (namely, that is smaller) is displayed.

Figure 4:
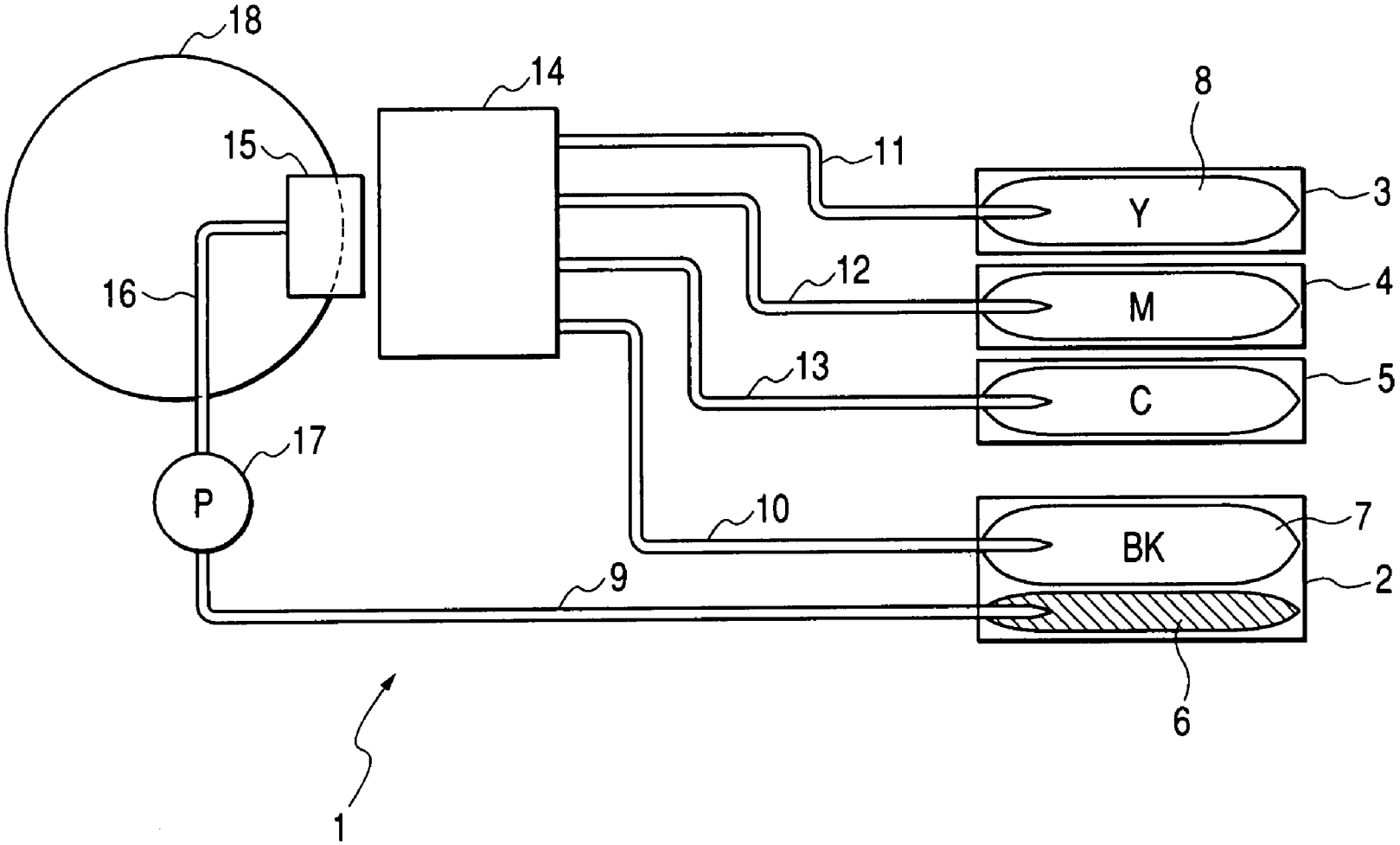
FIG. 4 schematically shows the structure of the overall ink supply and discharge system of a color ink jet recording apparatus.

In the following, a process for displaying the state of use of the ink cartridge according to the first embodiment of the present invention by means of the arrangement having been described with reference to FIGS. 2 and 4 will be specifically described with reference to a flow chart shown in FIG. 1.

Firstly, the host computer 200 commands, via the interface (IF) 204, the ink jet recording apparatus 230 to output the state of use of each ink cartridge to the interface 234. Having received the command, the MPU 231 detects the remaining amount of Y ink in step S101 and the percentage of the remaining amount of Y ink is determined by the following calculation and output to the interface 234 in step S102. That is, letting Ynow be the detected remaining amount of Y ink and letting Ymax be the initial fill of the Y ink bag, the state of use of the Y cartridge is calculated as (Ynow/Ymax×100)%. (In the following, the detected remaining amounts of M ink, C ink and BK ink will be represented as Mnow, Cnow and BKnow respectively, and the initial fills of the M, C and BK ink bags will be represented as Mmax, Cmax and BKmax respectively.) Similarly, the MPU 231 detects the remaining amounts of the M cartridge and C cartridge in steps S103 and S104, and calculates the state of use of the M cartridge (Mnow/Mmax×100)% and the state of use of the C cartridge (Cnow/Cmax×100)% to output them to the interface 234 in steps S104 and S106. Next, in the case of the waste ink combined BK cartridge, the remaining amount of BK ink is detected in step S107, and (BKnow/BKmax×100)% is calculated in step S108.

Then in step S109, the current waste ink amount (HKnow) is detected, and in step S110, how much amount of waste ink can be stored further is calculated. Letting Hkmax be the full waste ink storing capacity, the remaining storable amount of waste ink is calculated as (Hkmax−HKnow)/Hkmax×100.

Figure 3:
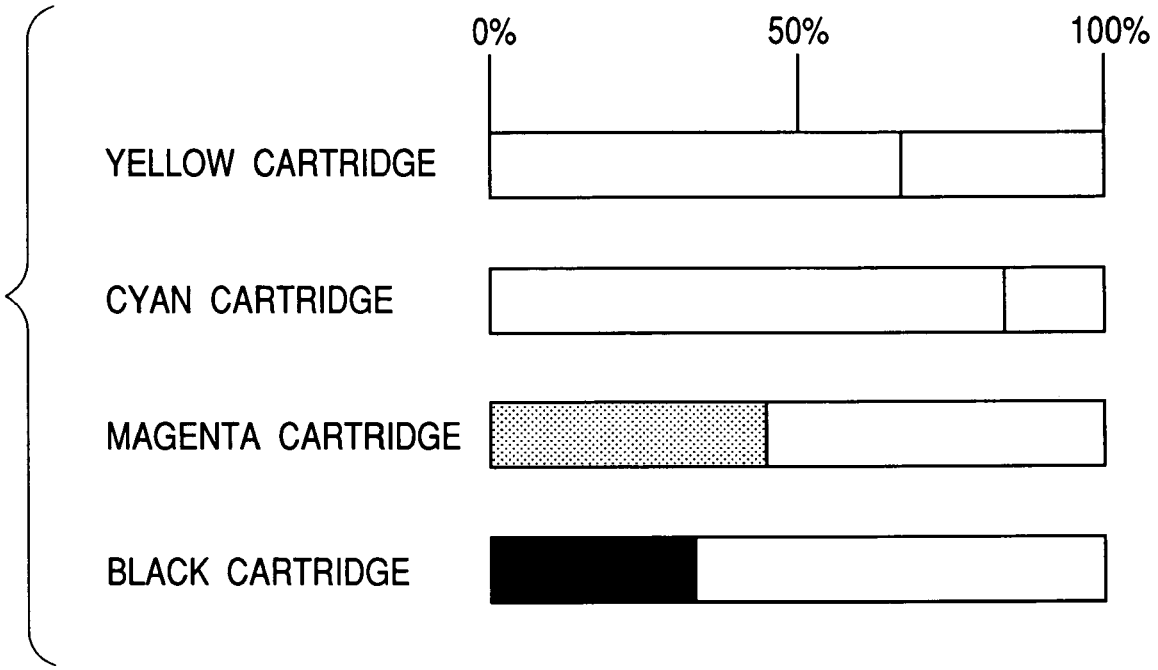
FIG. 3 schematically shows an example of display in which the state of use of each cartridge is indicated by the percentage.

Next in step S111, the percentage of the remaining amount of BK ink and the percentage of the remaining storable amount of waste ink are compared. In the case that the percentage of the remaining amount of BK ink is the smaller, the value calculated in step S108 is output to the interface 234 as the state of use of the waste ink combined BK cartridge in step S112. Contrary, in the case that the percentage of the storable amount of waste ink is the smaller, the value calculated in step S110 is output to the interface 234 as the state of use of the waste ink combined BK cartridge in step S113. The host computer 200 controls to display the state of use of each cartridge sent from the ink jet recording apparatus 231 via the interface 204 as illustrated in FIG. 3.

In the above-described first embodiment, the content of display is changed based on the amount of ink remaining in the cartridge and the amount of waste ink that can be stored in the cartridge.

In the case, for example, that display is performed based only on the amount of remaining ink as is usual in conventional arrangements, there may arise a situation where the amount of waste ink exceeds a prescribed amount in spite of that a significant amount of ink still remains, so that a warning is abruptly displayed or indication for prompting replacement of the ink cartridge is abruptly displayed. With the arrangement according to the present invention, the above-described problem occurring in conventional arrangements can be avoided. Therefore, the user can know the state of use of the cartridge, and therefore the user can expect the proper time for replacement of the cartridge.

Compactness of the cartridge is a significant factor for attaining downsizing of the apparatus. In the case that the space for storing waste ink is made small in favor of compactness of the cartridge, there is a possibility that the waste ink amount may reach a prescribed amount before the ink is fully consumed, depending on the frequency of recovery operations. According to the present invention, it is possible for users to know the proper time for replacement of the cartridge.

(Second Embodiment)

In the following, means for performing display or indication of the time for replacing an ink cartridge as a second embodiment of the present invention will be described.

The structure of the apparatus and its basic processes are the same as those in the first embodiment, and the detailed description thereof will be omitted.

The indication of the time for replacing a cartridge is performed by means of LEDs 1 to 4 designated by reference numerals 251 to 254 in FIG. 2. The LEDs 1 to 4 correspond to the Y, M, C and BK cartridges respectively, and when the time for replacing a cartridge comes, that fact is indicated by turning-on of the corresponding LED.

In this embodiment, detection and indication of the time for replacement are performed upon completion of printing of every page.

Every time printing of one page is finished, percentage of the remaining ink amount of each of the cartridges Y, M, C and BK is detected. In the case of the Y, M and C cartridges, when the remaining ink amount is lower than a threshold value, the corresponding LED is turned on. However, in the case of the BK cartridge, the amount of waste ink that can be stored is additionally calculated in the manner same as in the above-described first embodiment, and when the storable amount of waste ink is lower than a threshold value with regard to waste ink, the LED 4 is controlled to be turned on even if the remaining amount of BK ink is not lower than the aforementioned threshold value.

While in this embodiment, the detection and indication of the time for replacement is performed upon completion of printing of every one page, the detection and indication may be performed upon completion of printing of every one line or every several seconds. In these cases also, the advantageous effects of the present invention are realized.

According to the first embodiment, the above-described control process allow the user to know the state of use of an ink cartridge at a glance even in the case that the ink cartridge is a waste ink combined ink cartridge. According to the second embodiment, it is possible to inform the user of the proper time for replacing an ink cartridge positively with indication by an LED even in the case that the ink cartridge is a waste ink combined ink cartridge.

With the use of a combined cartridge, it has been made possible to provide a color ink jet recording apparatus that is advantageous in the apparatus size and cost.

In the above-described second embodiment, display or indication for prompting the user to replace a cartridge is performed based on the amount of ink remaining in the cartridge and the amount of waste ink that can be received by the cartridge.

In the case, for example, that display is performed based only on the amount of remaining ink as is usual in conventional arrangement, there may arise a situation where the amount of waste ink exceeds a prescribed amount in spite of that a significant amount of ink still remains, so that the operation of the apparatus is prohibited or indication for prompting replacement of the ink cartridge is abruptly displayed. With the arrangement according to the present invention, the above-described problem occurring in conventional arrangements can be avoided. Therefore, the user can know the state of use of the cartridge, and therefore the user can expect the proper time for replacement of the cartridge.

(Other Embodiments)

While in the above description of the embodiments, there have been described examples in which ink cartridges corresponding to respective colors are attached to an ink jet printing apparatus, the present invention can also be applied to a recording apparatus that uses an ink cartridge that can integrally accommodate inks of all of the colors. In the latter case, the invention is not limited to the arrangement in which the remaining amount of ink is displayed for each color, but the display may be performed for the remaining amount of the ink, among the inks of a plurality of colors (i.e., Y, M, C and BK inks), whose percentage of the remaining amount is the least or whose absolute remaining amount is the least. In addition, it is possible to adopt such an arrangement in which color inks of only yellow, magenta and cyan are included in a combined cartridge and an ink cartridge for black ink and an ink cartridge for the color inks can be replaced independently from each other. In this case also, the display may be performed for the remaining amount of the ink, among the inks of a plurality of colors, whose remaining amount is the least.

As to the way of detecting the remaining amount of ink or the amount of waste ink, conventionally know various technologies may be used. For example, the amount of consumed ink and the amount of ink discharged by recovery process may be calculated by counting the recorded dots based on the recorded data or counting the number of times of the recovery process performed. Furthermore, it is possible to adopt an arrangement for detecting decreased ink liquid level in the ink cartridge by means of an optical sensor or an arrangement having electrodes to detect the electric resistance or conduction condition between the electrodes.

In the first embodiment, the percentage of the remaining amount of ink relative to the initial fill of that ink and the percentage of the remaining storable amount of waste ink relative to the full capacity of the storing member are calculated and the smaller one of those percentages (or ratios) is displayed. However, the present invention is not limited to this feature.

For example, it is possible to adopt such an arrangement in which the absolute amount of remaining ink and the absolute amount of storable waste ink are calculated and either one of the remaining ink amount or the waste ink amount is selectively displayed. In addition, upon comparison of those absolute values, frequency of the recovery process relative to the amount of consumed ink may be estimated so that the comparison will be made on the results of calculations performed on the respective absolute amounts using predetermined coefficients.

Means for storing ink and waste ink is not limited to storing members in the form of bags like those described with reference to FIG. 4, but it may be an absorbing material disposed in the ink cartridge for absorbing ink and waste ink to retain them. Furthermore, it is possible to adopt such an ink tank arrangement in which the interior of the cartridge is partitioned into a plurality of rooms so that ink is retained in a room in which ink is retained in the form of liquid and a room in which an absorbing material is accommodated, which rooms are in communication with each other.

As to display of the amount of remaining ink as described in connection with the first embodiment or display of the time for replacing the ink cartridge, the display is not necessarily required to be presented on the body of the ink jet printing apparatus, but information on them may be output to a host computer as shown in FIG. 2 so that it may be presented on a monitor connected to the host computer.

What is claimed is:

1. An ink jet recording apparatus to which an ink cartridge provided with an ink storing member for storing ink to be used for recording and a waste ink storing member for storing waste ink discharged from a recording head is detachably attached to perform recording by ejecting ink supplied from the ink storing member of the attached ink cartridge out of the recording head, comprising:

recovery means for causing ink to be discharged from said recording head for a purpose other than recording;

a waste ink path that allows the waste ink discharged from the recording head by said recovery means to be stored in the waste ink storing member of said attached ink cartridge;

determination means for determining a remaining amount of ink in said ink storing member and a remaining storable amount of waste ink that can be stored in said waste ink storing member; and changing means for changing display on state of use of said ink cartridge based on the determined remaining amount of ink and remaining storable amount of waste ink, wherein said changing means changes which of said remaining amount of ink and said storable amount of waste ink is to be displayed, and wherein said changing means changes the display based on a percentage of the remaining amount of ink relative to an amount of ink storable in said ink storing member and a percentage of the storable amount of waste ink relative to a full amount of waste ink that can be stored in said waste ink storing member so as to display the amount corresponding to the relatively smaller one of those percentages.

2. A control method for an ink jet apparatus for performing recording by ejecting ink from a recording head, provided with recovery means for causing ink to be discharged from said recording head for a purpose other than recording, and to which an ink cartridge provided with an ink storing member for storing ink to be used for recording and a waste ink storing member for storing waste ink discharged from the recording head is detachably attached, comprising:

a determination step of determining a remaining amount of ink in said ink storing member and a remaining storable amount of waste ink that can be stored in said waste ink storing member; and a changing step of changing display on state of use of said ink cartridge based on the determined remaining amount of ink and remaining storable amount of waste ink, wherein in said changing step, which of said remaining amount of ink and said storable amount of waste ink is to be displayed is changed, and wherein in said changing step the display is changed based on the percentage of the remaining amount of ink relative to an amount of ink storable in said ink storing member and the percentage of the storable amount of waste ink relative to a full amount of waste ink that can be stored in said waste ink storing member so that the amount corresponding to the relatively smaller one of those percentages is displayed.

3. An ink jet recording apparatus to which a first cartridge accommodating an ink storing member for storing ink and a second cartridge accommodating an ink storing member for storing ink to be used for recording and a waste ink storing member for storing waste ink discharged by a recovery process are detachably attached to perform recording by ejecting ink supplied from the ink storing members of the attached ink cartridges out of a recording head, comprising:

remaining amount detection means for detecting a remaining amount of ink in the ink storing member of each of said first cartridge and said second cartridge;

waste ink amount detection means for detecting an amount of waste ink in said waste ink storing member;

means for displaying state of use of said first and said second cartridges; and control means for performing a control in such a way that the remaining amount of ink in the ink storing member of said first cartridge is displayed as the state of use of said first cartridge and the smaller one of a percentage of the remaining amount of ink in said second cartridge and an amount of waste ink that can be received in said waste ink storing member is displayed as the state of use of said second cartridge.

4. An ink jet recording apparatus to which a first cartridge accommodating an ink storing member for storing ink and a second cartridge accommodating an ink storing member for storing ink to be used for recording and a waste ink storing member for storing waste ink discharged by a recovery process are detachably attached to perform recording by ejecting ink supplied from the ink storing members of the attached ink cartridges out of a recording head, comprising:

remaining amount detection means for detecting a remaining amount of ink in the ink storing member of each of said first cartridge and said second cartridge;

waste ink amount detection means for detecting an amount of waste ink in said waste ink storing member;

means for displaying time for replacement of said first and said second cartridges; and control means for performing a control in such a way that the time for replacement of said first cartridge is displayed when an amount of ink remaining in the ink storing member of said first cartridge becomes a predetermined amount and the time for replacement of said second cartridge is displayed when an amount of ink remaining in the ink storing member of said second cartridge becomes smaller than a certain amount or when an amount of waste ink that can be received in said waste ink storing member becomes equal to or smaller than a certain amount.

* * * * *